US005862542A

United States Patent [19]

Page

[11] Patent Number: 5,862,542

[45] **Date of Patent: *Jan. 26, 1999**

[54] SHAMPOO BOWL HEADREST

[76] Inventor: Timothy Allen Page, 8211 Sidbury Rd., Wilmington, N.C. 28405

[ * ] Notice: The term of this patent shall not extend beyond the expiration date of Pat. No. 5,692,251.

[21] Appl. No.: 977,042

[22] Filed: Nov. 25, 1997

Related U.S. Application Data

[63] Continuation-in-part of Ser. No. 784,356, Jan. 23, 1997, Pat. No. 5,692,251.

[51] Int. Cl.[6] ..... A47K 1/04; A47K 3/12

[52] U.S. Cl. ..... 4/523; 4/516

[58] Field of Search ..... 4/523, 515, 516, 4/519, 517, 518, 520, 521, 522, 583

[56] References Cited

U.S. PATENT DOCUMENTS

| | | | |
|---|---|---|---|
| 570,107 | 10/1896 | Slee . | |
| 864,335 | 8/1907 | Raymond | 4/523 |
| 1,510,647 | 10/1924 | Bomar . | |
| 1,588,293 | 6/1926 | Bailey . | |
| 1,602,240 | 10/1926 | Miller . | |
| 1,961,244 | 6/1934 | Pottern . | |
| 2,516,601 | 7/1950 | Smalls . | |
| 2,527,868 | 10/1950 | Wilson | 4/523 |
| 2,732,565 | 1/1956 | Weber . | |
| 3,026,537 | 3/1962 | Schnell . | |
| 3,341,866 | 9/1967 | Wright . | |
| 4,352,216 | 10/1982 | Grim . | |
| 4,630,323 | 12/1986 | Sage et al. . | |
| 4,922,558 | 5/1990 | Porco . | |
| 4,998,303 | 3/1991 | Smithers . | |
| 5,177,820 | 1/1993 | Varallo . | |
| 5,239,711 | 8/1993 | Tafur . | |
| 5,692,251 | 12/1997 | Page | 4/516 |

*Primary Examiner*—Charles R. Eloshway

[57] ABSTRACT

A shampoo bowl headrest which supports the weight of the head and lessens pressure on the neck during various hair care techniques. The drain cup of this unit is firmly seated into the bowl drain and is attached to the base with a hand turnable tightening knob, said base running along the bowl basin to the front wall of the bowl, and affixing to a support post which adjusts for length laterally from said front wall. A disk adjoins the post for comfortability and adjustable height capabilities above the basin of the bowl. The disk overlaps the post to decrease any chance of hair entanglement at the connection point, and allows use of both bands during hair care techniques.

7 Claims, 2 Drawing Sheets

SHAMPOO BOWL HEADREST

This application is a continuation in part of application Ser. No. 08/784,356 filed on Jan. 23, 1997, now U.S. Pat. No. 5,692,251 issued on Dec. 2, 1997.

BRIEF SUMMARY OF THE INVENTION

It is an object of the present invention to improve upon related inventions, and provide for shampoo bowls, a headrest which will lessen the pressure on a person's neck during hair care techniques, by supporting the weight of the head.

Another object of this invention is furnishing a headrest for shampoo bowls which is fitted into the bowl drain for secure installation.

Another object of this invention is furnishing a headrest for shampoo bowls which is comprised of a round disk attached to an upright support post, which in turn fits into the base, and said base connects to a separate drain cup, secured into the drain, therefore providing the capability for holding one's neck and head in a comfortable position.

Another object of this invention is furnishing a headrest for shampoo bowls that will adjust to various heights, and therefore be compatible with different bowl and chair designs.

Another object of this invention is furnishing a headrest for shampoo bowls that can be adjusted for diverse neck lengths, by providing hole shafts to insert the upright support in, at different distances laterally from the front wall of the bowl.

Another object of this invention is furnishing a headrest for shampoo bowls whose base adjusts to different lengths of bowl basins, from the drain to the front wall, said length being diverse in various bowl designs.

A further object of this invention is furnishing a headrest for shampoo bowls which is long lasting by being made of materials which are water resistant and can hold up well to chemicals found in hair care products.

Additional objects of this invention will become apparent throughout the detailed descriptions of the specifications.

The above described objects of this invention are achieved with a head support consisting of five parts: 1.) a drain cup, 2.) a base, 3.) a tightening knob, 4.) a head disk, and 5.) an upright support post. As a complete unit, the parts are stabilized into the bowl drain with a drain cup which is attached to the base by a tightening knob, which in turn allows for lengthwise adjustment to different length bowl basins. The upright support post and head disk provide means of attaining angles of measurement needed with different neck lengths and chair designs.

DETAILED DESCRIPTION

Figure 1:
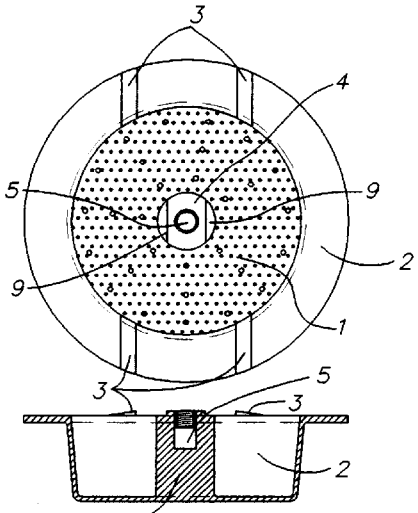
FIG. 1 shows two views of the drain cup. The uppermost drawing is a top view showing drain holes and the top of its center post, which is used for connecting the base. The lower drawing is a frontal view of the drain cup and post within said drain cup.

The drawings contained herein will be referred to in numeric progression to provide these descriptions. FIG. 1 shows two views of the drain cup 2 with the uppermost drawing looking down from above to allow sight of the drain holes 1, anti-swivel guides 3, top of center post 4, threaded opening 5 in post 4, and notches 9 in the top sides of the post 4. The drain holes 1 are for water drainage during hair care techniques. The anti-swivel guides 3, center post 4, notches 9, and threaded opening 5 provide stability when the parts are interconnected. The lower drawing shows the drain cup 2 from a front end view showing the anti-swivel guides 3 slightly raised on top of the drain cup 2. Also shown is a cutout of the drain cup 2 to show the post 4, and the threaded opening 5 in the post 4.

Figure 2:
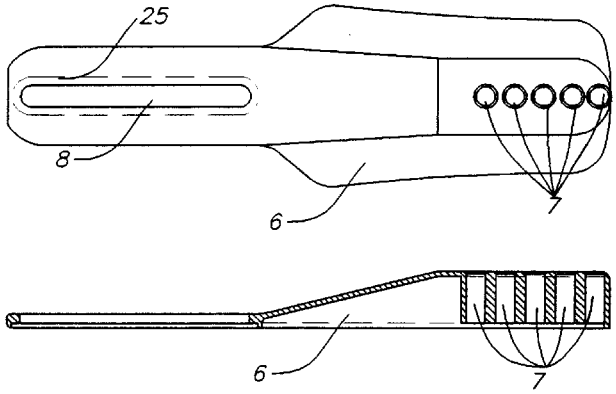
FIG. 2 shows two views of the base. The uppermost drawing is a top view showing the tops of the hole shafts used for neck length adjustments. Also shown is an opening cut into the end section of the base, which is slightly recessed to form a kind of rail, and slide onto the notched ends of the drain cup post, thus allowing for different length bowl basin adjustments. The lower drawing shows a side view of the base and hole shafts contained within.

FIG. 2 shows two views of the base 6 with the uppermost drawing looking down from above to allow sight of the hole shafts 7 which are used for different neck length adjustments. Also shown is an opening 8 cut into and though the end section of the base 6, and a slight recess 25, which allows it to slide onto the notches 9 in the top sides of the drain cup post 4. The lower drawing shows the base 6 from the side, along with the hole shafts 7 contained therein.

Figure 3:
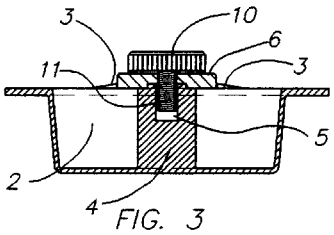
FIG. 3 is a frontal view of the drain cup showing the front end of the base connected to the drain cup post by a hand turnable tightening knob, within two anti-swivel guides.

FIG. 3 shows the drain cup 2 from a frontal view with the end of the base 6 slid onto the post 4 between the anti-swivel guides 3 and secured by a hand turnable tightening knob 10 with built-in metal bolt 11 inserted into the threaded opening 5 of the post 4.

Figure 4:
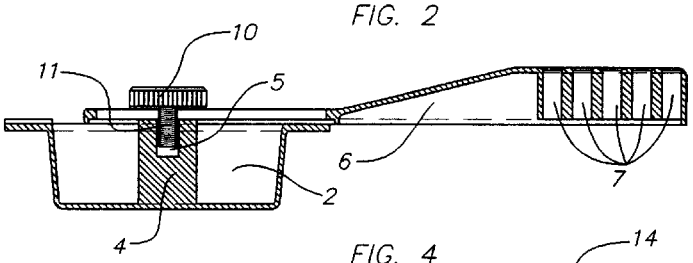
FIG. 4 is a side view of the base attached to the drain cup by means of a bolt in the tightening knob fitted into a threaded opening in top of the post of the drain cup.

FIG. 4 shows how the base with it's self-contained hole shafts 7 looks when connected to all parts of the drain cup 2, which consist of the post 4, and threaded opening 5, secured with the built-in metal bolt 11 of the tightening knob 10.

Figure 5:
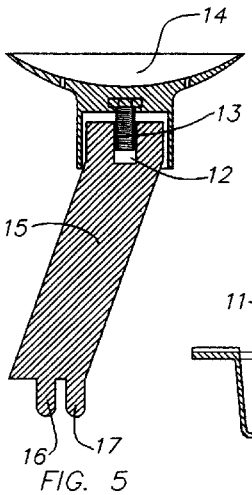
FIG. 5 is a side view of the upright support showing the head disk attached by a built-in metal bolt, threaded into an opening in the top of said support.

FIG. 5 shows the upright support 15 which has two protuberances 16,17 that are part of said upright support 15, extending from it's bottom to fit firmly into the hole shafts 7 of the base 6. The head disk 14 is connected to the upright support 15 by means of a built-in metal bolt 13 in a threaded opening 12 of the upright support 15. The head disk 14 can be adjusted up or down by rotating the metal bolt 13 left or right to allow for different bowl and chair designs.

Figure 6:
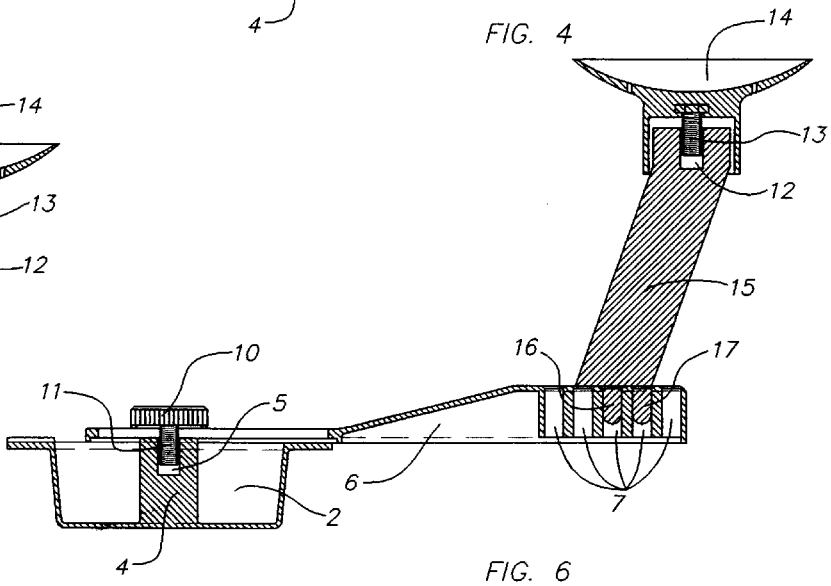
FIG. 6 is a perspective view of the headrest, as it would appear before installation, with all the parts connected.

FIG. 6 shows all the parts of the headrest connected as one, as it will conjoin before installation into the shampoo bowl. The drain cup 2 will firmly seat into the bowl drain opening for added stability. The base 6 will slide onto the post 4 of the drain cup 2 and be secured by hand turning a tightening knob 10 with it's metal bolt 11 threaded into the opening 5 on top of the post 4. Loosening the tightening knob 10 allows the base 6 to slide back and forth for different length adjustments from the front of the bowl to the back of the bowl, to meet varying bowl designs' dimensions. The head disk 14 with its built-in metal bolt 13, is threaded into an opening 12 in top of the upright support 15. In addition to allowing height adjustment capabilities, the head disk 14 skirts far enough over the top part of the upright support 15 to prevent hair entanglement around the metal bolt 13. The upright support 15 is fitted into the base 6 by two protuberances 16, 17 which are part of the upright support 15. The two protuberances 16, 17 fit snugly into the hole shafts 7 of the base 6 to inhibit twisting or turning of the upright support 15.

Figure 7:
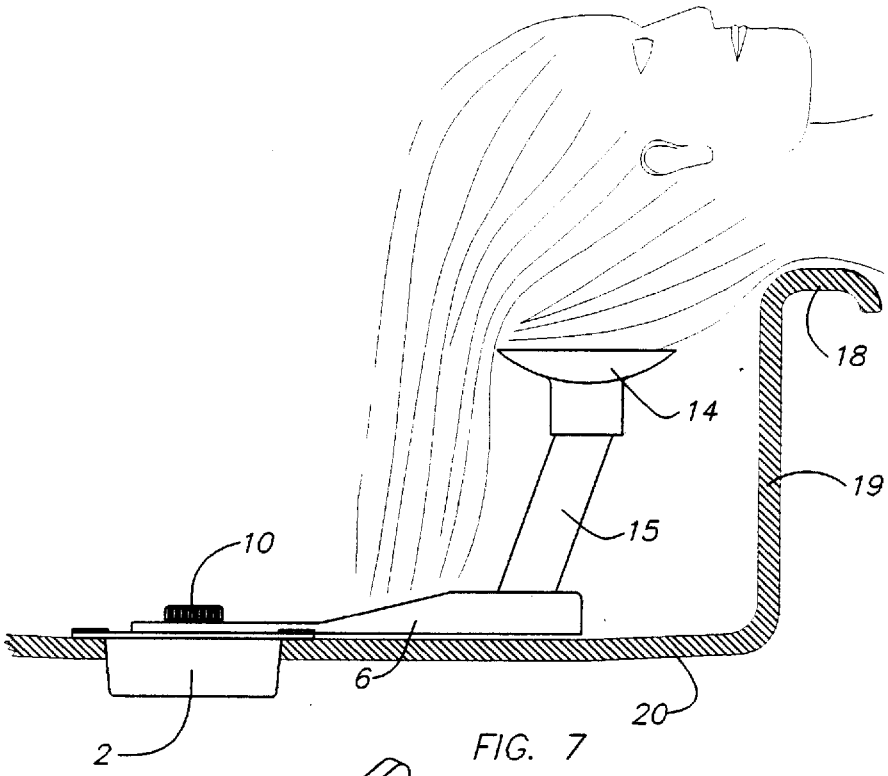
FIG. 7 is a pictorial view showing a person's head and neck lying in the depression of a shampoo bowl and being supported by the headrest.

FIG. 7 shows a person's head laying in the depression 18 of a shampoo bowl of which is displayed a front wall 19 and a basin 20. The person's head is reposing on a head disk 14, which is adjoined to an upright support 15, which is attached to the base 6. The base 6 is connected by a tightening knob 10, to the drain cup 2 which will be inserted into the bowl drain for immobility during hair care techniques.

Figure 8:
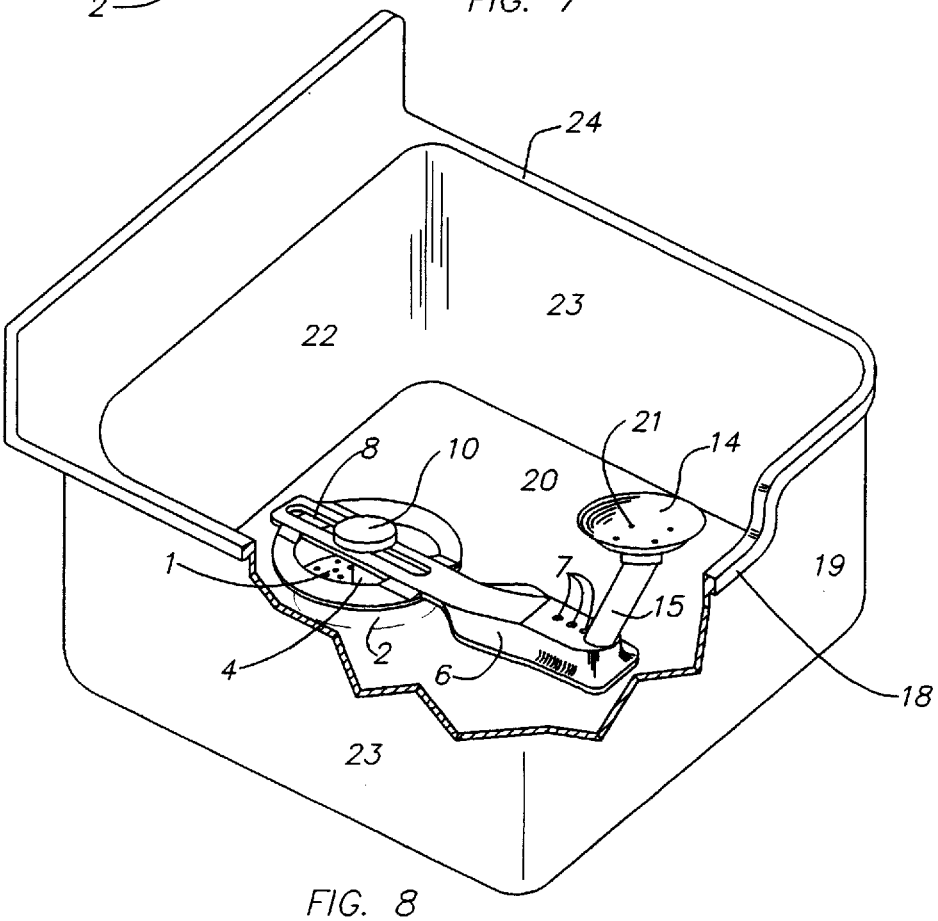
FIG. 8 is a perspective view of a shampoo bowl with a cutout to show installation of the present invention.

FIG. 8 is a view of a shampoo bowl 24 with a cutout showing the present invention after installation. An individual's head would lay in the depression 18 of the bowl 24 which consists of a front wall 19, a back wall 22, side walls 23, and a basin 20. The individual's head would repose on a head disk 14 of which there are four small drain holes 21 so water will not collect in the head disk 14. The head disk 14 is threaded onto an upright support 15 which in turn is fitted into the base 6. The hole shafts 7 allow for neck length adjustments from the front wall 19 without having to adjust the entire unit. The base 6 is slid onto the notched ends of the drain cup post 4 using the railed opening 8 for proper distance along the basin 20, and secured into place with the tightening knob 10. The bowl 24 drain is underneath the drain cup 2, of which the drain cup 2 has drain holes 1 to allow adequate water drainage. The drain cup 2 is firmly seated into the bowl 24 drain.

I claim:

1. A headrest for a shampoo bowl which has a rim depression for supporting the neck of an individual such that the individual's head is suspended over the bowl, said headrest supporting an individual's head during hair care techniques, so as to afford comfort and hands free working conditions, said headrest consisting of:

(a) a base fitted to lie along the bottom wall of the bowl;

(b) a drain cup which is attachable to the base by a hand turnable tightening knob so as to secure the base to the bowl drain;

(c) an upright support post conjoined to the base having a head disk joined thereto, shaped to comfortably encompass an individual's back ball part of their skull structure.

2. The headrest of claim 1 wherein the drain cup is adapted to be seated firmly into the bowl drain to provide stability.

3. The headrest of claim 1 wherein the base is adjustable along the bowl bottom wall laterally from front wall to back wall to accommodate different bowl bottom wall lengths.

4. The headrest of claim 1 wherein said upright support is adjustable laterally on the base to accommodate for different neck lengths, and is made of durable material to allow for weight variances.

5. The headrest of claim 1 wherein said head disk is adjustable up and down for height to accommodate different bowl and chair designs.

6. The headrest of claim 1 wherein said headrest is removably attachable to the bowl.

7. The headrest of claim 1 wherein said base, said drain cup, said head disk, said upright support, and said tightening knob are made from water resistant materials impervious to chemical additives found in hair care products.

* * * * *